US005799604A

United States Patent [19]

Long

[11] Patent Number: 5,799,604

[45] Date of Patent: Sep. 1, 1998

[54] TRIANGULATED CHEVRON RIB STRUCTURE FOR A BOAT HULL

[76] Inventor: Charles C. Long, Rte. 16, Box 1236, Lebanon, Mo. 65536

[21] Appl. No.: 756,661

[22] Filed: Nov. 12, 1996

Related U.S. Application Data

[62] Division of Ser. No. 283,043, Jul. 29, 1994, Pat. No. 5,640,923.

[51] Int. Cl.[6] ..... B63B 3/00

[52] U.S. Cl. ..... 114/359; 114/356

[58] Field of Search ..... 114/65 R, 355, 114/359, 56

[56] References Cited

U.S. PATENT DOCUMENTS

| | | | |
|---|---|---|---|
| 1,837,711 | 12/1931 | Heinemann et al. | 114/358 |
| 2,352,296 | 6/1944 | Szego | 114/65 R |
| 2,400,771 | 5/1946 | Moxham, Jr. | 114/65 R |
| 2,422,183 | 6/1947 | Clement, Jr. | 114/358 |
| 2,662,237 | 12/1953 | Carey | 114/358 |
| 3,179,961 | 4/1965 | Ward et al. | 114/356 |
| 3,736,608 | 6/1973 | Whitehead | 114/356 |
| 3,747,551 | 7/1973 | Bennekers | 114/65 R |
| 3,943,586 | 3/1976 | Palmer | 114/356 |

*Primary Examiner*—Jesus D. Sotelo

*Attorney, Agent, or Firm*—Edward D. Manzo; Gregory Osterloth

[57] ABSTRACT

A new boat hull support structure is provided in which a chevron rib support structure is used throughout the hull of an aluminum boat. This rib structure provides superior resiliency due to the increase of surface area contact between the boat hull and support ribs. The support ribs are constructed from a plurality of V-shaped ribs, having summit sections and trailing ends connected to transverse braces. The ribs are riveted to the hull, with each successive rib connected to the preceding rib at a point in the forward one quarter of the preceding rib and the center of the transverse brace through a connector plate. A continuous triangular structure is provided which distributes impact loading across the width, as well as, the length of the structure.

20 Claims, 2 Drawing Sheets

TRIANGULATED CHEVRON RIB STRUCTURE FOR A BOAT HULL

This application is a division of copending U.S. application Ser. No. 08/283,043, filed on Jul. 29, 1994, now U.S. Pat. No. 5,640,923.

FIELD OF THE INVENTION

The invention generally relates to a chevron rib structure used within a boat hull which extends from the bow to the stern of the boat and utilizes cross members to interconnect adjoining ribs.

BACKGROUND OF THE INVENTION

Heretofore, boat hulls have been proposed, such as those disclosed in U.S. Pat. No. 2,352,296 (Szego); U.S. Pat. No. 2,400,771 (Moxham); U.S. Pat. No. 2,662,237 (Carey); U.S. Pat. No. 3,736,608 (Whitehead); and U.S. Pat. No. 3,747,551 (Bennekers).

The patent to Bennekers discloses a boat hull constructed of a plurality of plates which are bent and secured together through weld seams. The plates are welded to a plurality of bulb irons, each of which extends parallel to one another in spaced relation and parallel to the generatrices of the developed surface formed by the sheet. The sheet is bent in one direction perpendicular to the alignment of the irons such that the irons remain straight and parallel to one another. Once bent in the desired manner, transverse stiffening members are added, along with temporary supporting means.

The patent to Whitehead discloses a water vessel having a double hull which is constructed with a pair of partitions attached to the bottom surface of the main bottom and exposed along the longitudinal axis of the vessel. The partitions are connected to a forward transverse partition and a stern panel. Laterally disposed partitions extend outward from opposite sides of the longitudinally disposed partitions to the outer edges of the main and auxiliary bottoms. The laterally disposed partitions are preferably disposed along axes which are inclined with respect to the longitudinal axis of the vessel and extend in a rearward direction toward the edges of the bottoms. The main and auxiliary bottoms are further connected by a plurality of ribs which extend parallel to and between each of the lateral partitions inward by a predetermined distance.

The patent to Moxham discloses a boat hull having a bottom shell with a keel extending along a longitudinal axis thereof. Straight frame members are constructed along the bottom shell and the top side shell for support. Moxham further illustrates a stern portion of the boat having a keel formed of a T-bar. Frame members which are ordinarily flat, straight stock formed of metal bars, angles or channels, are connected to the chines at one end and to the flat floors at the other end. The frame members support the shell.

The patent to Carey discloses a boat hull construction having a keel and stem to form one longitudinal frame member while the other longitudinal frame member is constructed from two gunwale members. Stringers are provided along the keel and the gunwale members, including a stringer extends from a point in the keel to a point adjacent the upper end of the stem. The ends of the stringers are connected to the keel through slots formed therein. A series of frame members are extended between the keel and the gunwale members. The frame members are slotted to permit the stringers to pass therethrough. The frame members include an inner skin and an outer skin each formed of planks arranged diagonally between the keel and the gunwale members in a direction diagonally opposite to that in which the stringers extend.

However, the systems presented thus far have met with limited success. Many of these systems require an unduly large amount of materials within the hull to maintain structural integrity. These excessive materials translate into increased assembly time and increased weight. Additionally, many conventional systems utilize rivets to secure the supporting rib structures to the hull. Each rivet presents a potential leak, and thus as the number of rivets increases, so does the future expenses for repairs.

Also, a conventional system has been proposed which utilizes a transverse support structure, wherein each support extends laterally across the boat in a direction perpendicular to the boat's length. Each transverse support is secured to the hull through a series of rivets aligned in a direction also transverse to the boat's length.

However, this transverse support structure has afforded many problems, such as cracking along the rivet line. Specifically, the transverse support structure produces a hinge line along each rivet line. These hinge lines translate into a section of the hull which experiences an undo stress and corresponds to the weakest point within the hull. Rivet-to-rivet cracking occurs in part due to the fact that each support provides a discrete and independent region of the hull which is supported. These regions are relatively strong and rigid. Consequently, as the hull experiences a force along a support, it transfers this force to the single corresponding support. The support transfers the force along its length to the points of contact with the hull. Hence, the loading forces are transferred to the rivet line. Once this concentrated force exceeds the load bearing capabilities of the hull, a failure occurs at the weakest point within the hull. In a transverse support structure, this weakness is most prevalent at the rivet line since the rivet holes produce a somewhat perforated hull cross-section and create a prying point when a force is experienced.

Moreover, the boat hull supporting structures presented in the past have required overly complex assembly processes. Many of these conventional boats require the support structure to be assembled in a piecemeal manner within the boat-after the hull has been formed. Such a piecemeal construction is labor intensive and time consuming. Further, as the individual support sections are attached, they must conform to a preformed hull contour. Thus, if the hull is formed with irregularities or uneven contours, the components of the support structure added thereto will become similarly uneven.

A need remains within the industry to provide an improved boat hull construction. It is an object of the present invention to meet this need.

SUMMARY OF THE INVENTION

It is an object of the present invention to provide a boat hull structure having a chevron rib construction with overlapping ribs to increase the percentage of surface contact between the rib structure and the hull.

It is another object of the present invention to provide a boat hull support structure which may be constructed in a uni-body manner prior to assembly within the hull.

It is another object of the present invention to provide a boat hull structure which reduces the materials and weight, and assembly time, while maintaining the structural integrity of the boat.

It is another object of the present invention to reduce the number of rivets necessary to secure a rib construction to the boat hull.

It is another object of the present invention to reduce rivet-to-rivet cracking by improving the load bearing structure within the hull and stresses experienced by the hull.

It is another object of the present invention to prevent concentrated loading within the hull by overlapping multiple V-shaped ribs along the keel of the boat inter-connected with cross members.

In summary, a new boat hull support structure is provided in which a chevron rib support structure is used throughout the hull of an aluminum boat. This rib structure provides superior resiliency due to the increase of surface area contact between the boat hull and support ribs. The support ribs are constructed from a plurality of V-shaped ribs, having summit sections and trailing ends connected to transverse braces. The ribs are riveted to the hull, with each successive rib connected to the preceding rib at a point in the forward one quarter of the preceding rib and the center of the transverse brace through a connector plate. A continuous triangular structure is provided which distributes impact loading across the width, as well as, the length of the structure.

Thus, an embodiment of the present invention uses a plurality of independently triangulated structures, each having ribs joined at a respective apex and a cross beam connected at the outer portions. Preferably the apexes point to the fore of the boat. Preferably each triangulated structure is nested within an adjacent triangulated structure, although they are not fully seated. However, another feature of the invention is that the amount of nesting is not constant: that is, the distance between adjacent cross beams of the triangulated structures is not constant, and varies along the length of the boat.

Yet another feature of the present invention is that a given cross beam may form part of one triangulated structure and further be secured to another triangulated structure, generally at a summit portion of that other triangulated structure. Preferably, a plurality of such cross beams are so connected.

Yet another aspect of the present invention is that not all of the V-shaped ribs are connected to corresponding cross beams. In the preferred embodiment, the ribs near the bow of the boat are not connected to cross beams.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
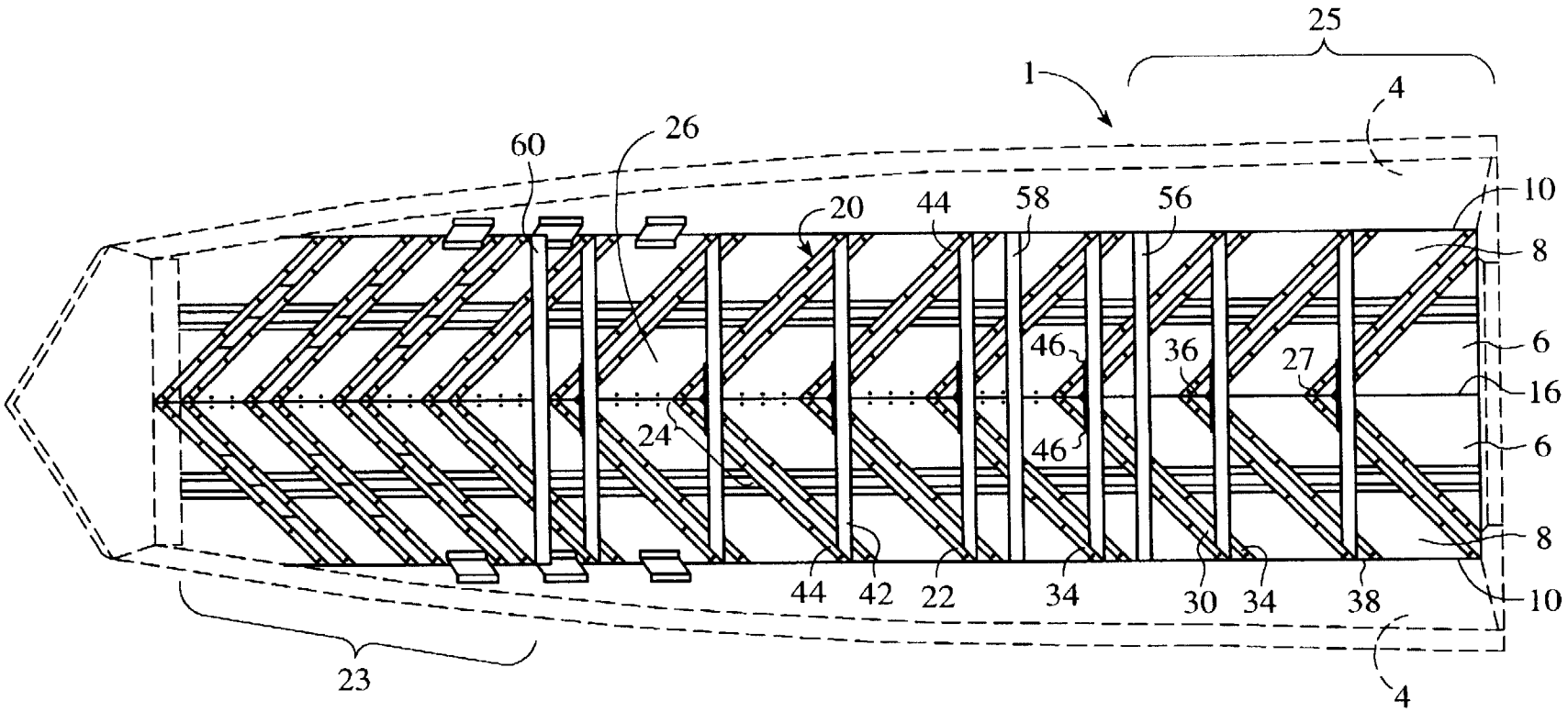
FIG. 1 illustrates a top plan view of a boat hull construction according to the present invention.

FIG. 1 generally illustrates a boat hull construction according to the present invention designated by the reference numeral 1. The boat 1 includes a sheet of material forming the hull 2 which is shaped to include side sections 4 which adjoin inner and outer keel portions 6 and 8. The outer keel portions 8 and side sections 4 combine to form a chine 10 along opposite sides of the hull 2. Inner keel portions 6 for opposite sides of the boat join one another to form the keel 12 (see FIGS. 2 and 3) and keel line 16 (FIGS.) which extends along the boat's longitudinal axis. Optionally, corrugations 14 may be provided along the hull and aligned in a direction parallel to the longitudinal axis of the boat. These corrugations 14 stiffen the hull and increase its strength. The hull 2 receives a uni-body chevron rib structure 20 therein, and secured thereto through rivets, for load bearing support. The chevron rib structure 20 extends from the bow to the stern of the boat.

Figure 2:
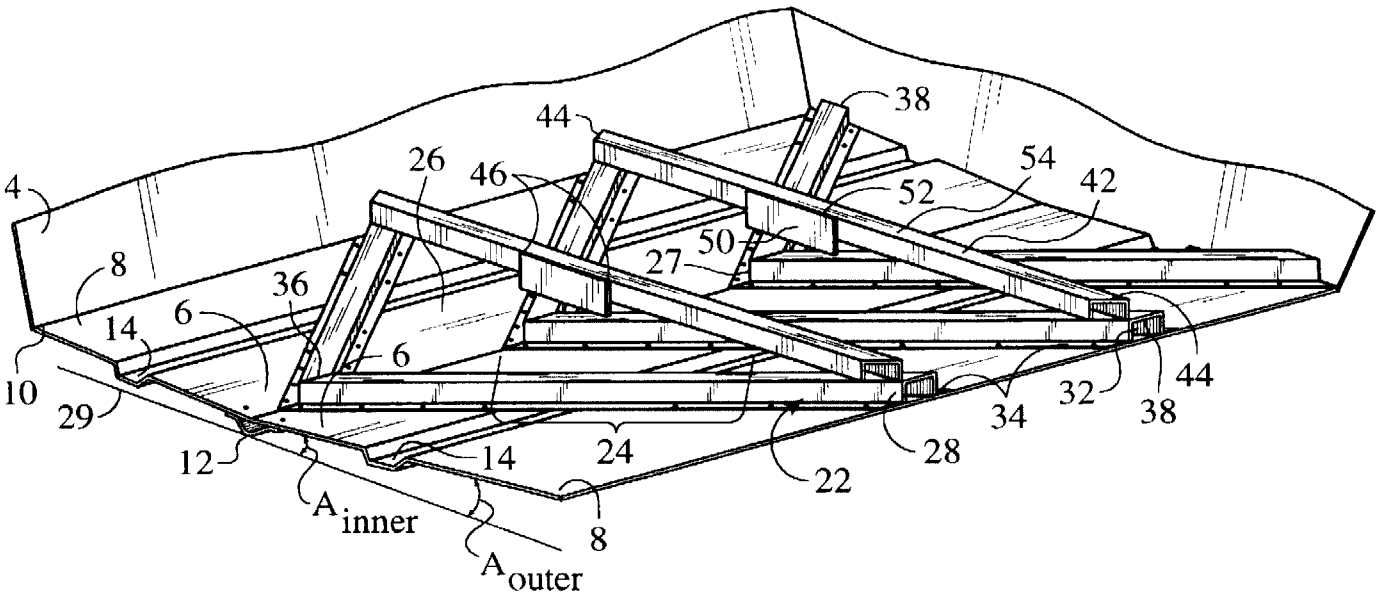
FIG. 2 illustrates an end sectional perspective view of a portion of the boat hull structure remote from the bow of the boat according to the present invention.

As illustrated in FIG. 2, the inner and outer keel portions 6 and 8 extend upward from a horizontal plane 29 extending perpendicular to the keel 12 (indicated by dashed line) at differing angles. This angle is referred to as the "dead rise". The inner keel portions 6 are configured with a dead rise angle $A_{inner}$ which may be less than the dead rise angle $A_{outer}$ of the outer keel portions 8. The dead rise angles $A_{inner}$ and $A_{outer}$ vary continuously along the length of the boat, such that the dead rise angles are greatest proximate the bow and smallest proximate the stern. Therefore, as the hull extends from the stern to the bow, the dead rise angles $A_{inner}$ and $A_{outer}$ vary from a small angle (i.e. close to horizontal) proximate the stern to a large angle proximate the bow. By way of example only, the dead rise of either portion 6 or 8 at the stern is approximately 6° while that at the bow is approximately 16°. These angles will depend upon the particular type of boat, within which the support structure is to be installed. Moreover, the instant invention may be utilized within a "john" type boat which utilizes a substantially flat bottom.

Thus, the inner and outer keel portions 6 and 8 may represent a substantially flat surface. As illustrated in FIG. 2, the chevron rib structure 20 is configured to follow the angular contour of the inner surface of the hull.

As illustrated in FIG. 1, the chevron rib structure 20 comprises a plurality of V-shaped ribs 22 which are aligned with respect to one another such that a summit section 24 of each rib extends into the valley section 26 of the preceding rib. The distance between adjoining ribs 22 may be varied depending upon the amount of support needed for a particular region within the hull 2. For instance, the bow portion 23 of the boat experiences larger instantaneous forces (from the continual pounding of the hull upon the water), and thus the ribs 22 are spaced more closely as compared to the stern 25. By way of example only, the ribs 22 in the bow 23 may be arranged such that the summit section 24 corresponds to substantially half of each rib 22 which extends into the valley section 26 of the preceding rib 22. The valley section 26 is approximately defined by an imaginary line (not shown) extending between the rearmost tips of the rib 22. In contrast, by way of example only, the ribs 22 in the stern 25 of the boat may be spaced further apart, such that the summit section 24 corresponds to less than one-third of each rib 22 which extends into the valley section 26 of the preceding rib 22.

Each rib 22 is constructed from two hat-shaped legs 28 (FIG. 3) having a rectangular shaped cross-section with a plateau 30 formed integrally with vertical sides 32 to form a channel shape. Lower ends of each vertical leg are integrally formed with lateral rims 34 extending outward therefrom in opposite directions. Once installed, each rib 22 is aligned along the central longitudinal axis of the boat with its apex 27 extending forward and the tail ends 38 of each leg 28 extending backward.

Tail ends 38 are mitered to abut against the side sections 4 of the boat. Pairs of hat-shaped legs 28 are joined along leading edges 36 to afford the V-shaped construction with a substantially right angle intersection between respective legs 28. Specifically, each leading edge 36 is cut to form a compound angle with the corresponding leading edge 36 of an adjoining hat-shaped leg 28. This compound angle is chit such that the leading edge 36 and the vertical sides 32 form substantially a 45° angle within a horizontal plane extending along the plateau 30 thereof. Each leading edge 36 is also cut to form an acute angle with a vertical plane extending perpendicular to the plateau 30 of the corresponding leg 28.

As illustrated in FIG. 1, the ribs 22 remotely located from the bow are secured to cross beams formed as U-shaped channels 42. The U-shaped channels 42 are aligned perpendicular to the longitudinal axis 16 of the boat and transverse corresponding ribs 22. Each U-shaped channel 42 includes mitered outer edges 44 secured to the tail ends 38 of a corresponding rib 22. The mitered edges 44 are positioned flush with the front vertical sides 32 of a corresponding rib 22. Each U-shaped channel 42 includes a central region 46 which coincides with the summit section 24 of an adjoining rib 22.

As illustrated in FIG. 2, each hat-shaped leg 28 is secured to, and follows the inner contour of, the inner and outer keel portions 6 and 8. Thus, the adjoining hat-shaped leg 28 forming a rib 22 extend outward and upward as viewed from the front to form an angle with respect to the horizontal plane 29 extending perpendicular to the keel 12. By way of example only, the dead rise angle between each hat-shaped leg 28 and the horizontal plane 29 may range from 6° (at the stern of a boat) to 16° (at the bow of a boat). Therefore, when the ribs 22 are aligned in the chevron structure 20, the summit section 24 of each rib 22 is positioned below the tail end 38 of the immediately adjacent preceding rib 22.

The central region 46 of each U-shaped channel 42 is secured to a rectangular shaped plate 50 having an upper edge 52 aligned substantially flush with the top surface 54 of a corresponding U-shaped channel 42. Each plate 50 extends below the bottom of the corresponding U-shaped channel 42 and is secured to the plateau 30 of the corresponding rib 22 proximate the summit section 24. The plates 50 are used to secure central regions 46 of each U-shaped channel 42 to the corresponding rib 22.

Figure 3:
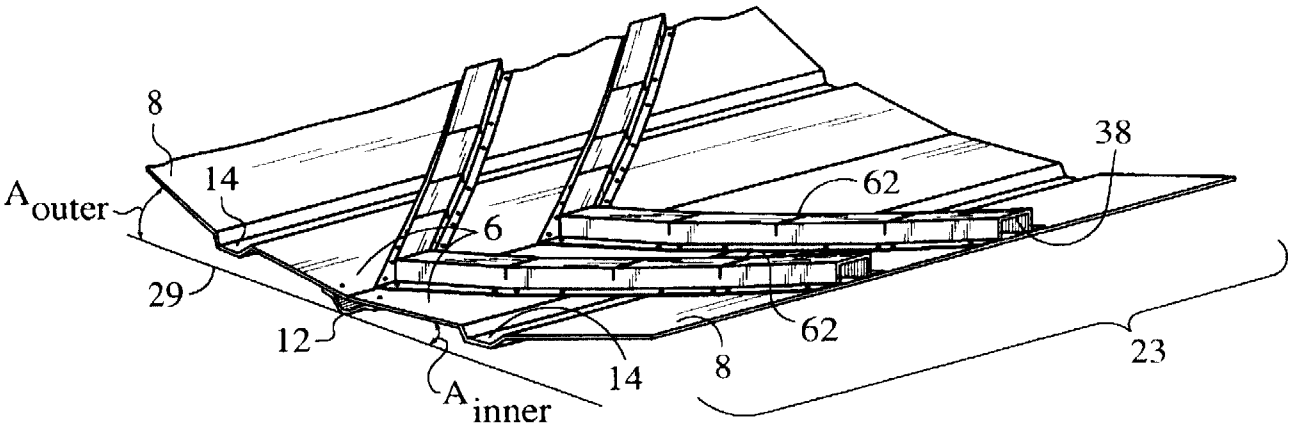
FIG. 3 illustrates an end sectional perspective view of a portion of the boat hull structure proximate the bow of the boat according to the present invention.

As illustrated in FIGS. 2 and 3, the inner and outer keel portions 6 and 8 remote from the bow of the boat are formed with substantially similar dead rise angles. Consequently, the hat-shaped legs 28 extend there across may be formed with a substantially straight length. Hence, the straight legs 28 include an intermediate region slightly raised off of the hull proximate the intersection of the keel portions 6 and 8. The lateral rims 34 may be slightly bent as needed to compensate for this raised region and any differences in the dead rise angles $A_{inner}$ and $A_{outer}$ between adjoining inner and outer keel portions 6 and 8 proximate the intersection thereof.

However, as the ribs 22 move toward the bow of the boat, the dead rise angles of the inner and outer keel portions 6 and 8 change at different rates, such that the difference therebetween increases. Once this difference crosses a maximum threshold, the lateral rims 34 of each hat-shaped leg 28 are unable to compensate for the difference in dead rise angles. Consequently, the legs 28 must be formed in a pattern to enable the channels to bend, thereby substantially following the contour of the hull 2. This curvature may be achieved by cutting V-shaped slots 62 into the plateau 30 and vertical sides 32 of each leg 28 to enable the leg 28 to bend. The cuts 62 are spaced along the length of each leg 28 in the bow section of the boat in frequency and number as necessary to follow substantially the contour of the hull 2. Once folded, the cuts 62 are welded shut to stabilize the legs 28. Optionally, the legs 28 requiring this bent contour may be prefabricated with the desired contour, such as in the molding process.

Bulkhead support cross beams, also formed as U-shaped channels 56, 58 an 60, are included to support the bulkheads (not shown). As illustrated in FIG. 1, the bulkhead support cross beams are provided with a foremost support 56 proximate the bow and intermediate and rear supports 58 and 60 proximate the stern. Each of the bulkhead support cross beams 56, 58 and 60, and support channels 42 are secured to underlying ribs 22, such as through welding and the like. The plates 50 are similarly secured to corresponding support channels 42 and ribs 22. The ribs 22 are secured to the boat hull, such as by riveting the lateral rims 34 of each rib 22 to the inner and outer keel portions 6 and 8.

The present invention may be constructed in a variety of ways, so long as the chevron rib structure 20 is securely mounted within the hull of the boat. For instance, the chevron rib structure 20 may be preformed into a uni-body structure and placed into the hull 2 as a single frame work. Alternatively, the chevron rib structure 20 may be constructed by individually securing each rib 22 and cross beam 42, 56, 58 and 60 within the hull 2.

More specifically, the present chevron rib structure may be formed into a uni-body configuration in accordance with the following method. Initially, the legs 28 and cross beams 42, 56, 58 and 60 are formed and opposite ends thereof are cut to the desired angles. The leading edges 36 of the legs 28 are cut to form the complex angle as described above. As each leg 28 will be inserted into a portion of the hull having different dead rise angles $A_{inner}$ and $A_{outer}$, each complex angle will differ. By way of example only, in a hull having a dead rise angle ranging from 6°–16°, the vertical angle cuts of the leading edges 36 will range from 4° to 8° in ¾° progressions in each rib 22 from the stern to the bow. Also, each plate 50 is precut with a desired height. In the foregoing example, the plates 50 are cut to span progressively larger gaps between the cross beam 42 and rib 22 (from 2"–2 13/16"). Next, the legs 28 are placed in the desired arrangement, such as in a mold equal in length and contour to a desired boat hull 2. The V-shaped ribs 22 within the bow section are cut to form the cuts 62 and bent to conform to the contour of the mold (or prefabricated in this contour). The cuts 62 are welded to maintain these foremost ribs 22 at the desired contour.

Next, the cross beams 42 are aligned and secured to tail ends 38 of the corresponding ribs 22. The bulkhead support cross beams 56, 58 and 60 are also secured to corresponding V-shaped ribs 22. The plates 50 are secured to the cross beams 42 and the ribs 22. In this manner, a uni-body chevron rib structure 20 is produced. This rib structure 20 is placed within the boat hull and the ribs 22 and channels 42, 56, 58 and 60 are secured to the hull 2, such as through rivets, welding and the like. The ribs 22 for the bow section are also installed and riveted to the hull 2.

Alternatively, the foregoing method may be followed, except that the assembly process is carried out in the hull 2, not in a simulated framework. Hence, each rib may be separately spaced within the hull 2 and riveted thereto. Thereafter, the cross beams 42, 56, 58 and 60, and plates 50 are secured to corresponding ribs 22.

The foregoing chevron rib structure 20 prevents concentrated loading as explained below. During operation, as the boat hull 2 impacts waves, the corresponding region of the hull transfers this impact force to the overlapping and immediately adjacent rib 22. This rib 22 further transfers the impact along its V-shaped length and to the over-lapping cross beams 42 contacting its summit section 34 and tail end 38. These cross beams 42 further transfer the impact to preceding and succeeding ribs 22. In this manner, each individual impact is disbursed along a plurality of ribs 22 and cross beams 42. This disbursement is further enhanced by the increased surface area contact facilitated by aligning the ribs 22 in a chevron arrangement. As a wave contacts a region of the hull, the impact is transferred, through the ribs 22 and cross beams 42, along the hull in a direction somewhat parallel to the direction in which the boat is traveling. Consequently, the force is nor merely transferred along a transverse region of the boat hull. Plus, the effected lateral region of the hull 2 intersects at least two ribs which extend in opposite directions therefrom. Thus, the stressed portion of the hull experiences reinforcing counter forces from multiple ribs, thereby improving the support structures effectiveness.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings 1–3 is to be interpreted as illustrative, and not in a limiting sense.

What is claimed is:

1. A chevron rib structure for providing support in a boat hull, said boat having a fore, said structure comprising:

a hull, having fore and aft sections, including opposite side sections extending along a length of said hull, said side sections combining at a keel line extending along a longitudinal center axis of said hull;

a plurality of triangulated structures pointing to said fore of the boat and being formed by a plurality of V-shaped ribs and a plurality of cross beams connected thereto;

each said V-shaped rib being secured to an inner surface of said hull and aligned with respect to other said V-shaped ribs in a chevron configuration, each of said ribs including legs which join to form said V-shape, each of said ribs having a summit section proximate an apex thereof and a valley section between adjoining legs, said ribs being positioned proximate one another such that said summit section of each rib extends into said valley section of a preceding rib located fore thereof, said legs having lower surfaces secured to said hull;

each of said cross beams being secured to at least one corresponding V-shaped rib, each of said cross beams traversing said boat hull.

2. A chevron rib structure for providing support in a boat hull, according to claim 1, wherein said legs are constructed with a hat-shaped cross section having lateral rims extending outward from opposite sides thereof, said lateral rims being secured to said hull.

3. A chevron rib structure for providing support in a boat hull, according to claim 1, wherein front ends of said legs are formed with a complex angle such that said front ends and sides of each leg substantially form a 45° angle with a keel center line, in a horizontal plane, and said front ends form an acute angle with a vertical plane extending through an outermost edge of said front end.

4. A chevron rib structure for providing support in a boat hull, according to claim 1, wherein each of said ribs extends from outer sides of said hull forward and downward along said side sections until an apex of each rib joins said keel line.

5. A chevron rib structure for providing support in a boat hull, according to claim 1, wherein said cross beams are constructed from U-shaped channels.

6. A chevron rib structure for providing support in a boat hull, according to claim 1, wherein each of said cross beams has outer ends secured to tail ends of a corresponding fore rib, extending from said cross beam toward the fore section of the hull, and wherein each of said cross beams has a center section secured to a summit section of a corresponding aft rib, extending from an aft section of the hull at least to said cross beam.

7. A chevron rib structure for providing support in a boat hull, according to claim 6, further comprising bulkhead support cross beams for supporting bulkheads of the boat, said bulkhead support cross beams traversing, and being secured to, at least one of said ribs.

8. A chevron rib structure for providing support in a boat hull, according to claim 6, wherein each side section includes inner and outer keel sections extending parallel to one another and to said keel line, said inner and outer keel sections, proximate said bow, having differing dead rise angles with respect to a horizontal plane extending through said keel line.

9. A chevron rib structure for providing support in a boat hull, according to claim 8, wherein said inner and outer keel sections are joined along corrugations extending along a length of said hull.

10. The chevron rib structure for providing support in supporting a boat hull according to claim 6, wherein a spacing between adjacent ribs is greatest proximate said stern and least proximate said bow.

11. A chevron rib structure for providing support in a boat hull, according to claim 1, wherein a spacing between adjacent ribs is greatest proximate said stern and least proximate said bow.

12. A chevron rib structure for providing support in a boat hull, according to claim 1, wherein said ribs extend from said stern to said bow of said hull.

13. The chevron rib structure for providing support in a boat hull according to claim 1, wherein the number of said cross beams is smaller than the number of said V-shaped ribs, and wherein a plurality of said V-shaped ribs in said fore section are not connected to corresponding cross beams.

14. The chevron rib structure for providing support in a boat hull according to claim 1, wherein each of said cross beams is secured to outer ends of corresponding first V-shaped ribs, proximate a chine, and wherein each of said cross beams is secured also to a summit section of second V-shaped ribs located aft of said first V-shaped ribs.

15. A support structure for providing support in a boat hull comprising:

a plurality of independent triangulated structures having apexes pointing toward a fore section of said boat hull;

each of said triangulated structures being formed by a cross beam connected to outer ends of a pair of legs of a rib structure, said pair of legs meeting at an apex of the triangulated structure;

said triangulated structures being at least partially nested.

16. The support structure for supporting providing support in a boat hull according to claim 15 wherein each of said triangulated structures is connected to a cross beam of another one of said triangulated structures.

17. The support structure for supporting providing support in a boat hull according to claim 16 further comprising:

a plurality of plates, each connected to a summit section of a said triangulated support structure and to a central section of a cross beam of a cross beam of an adjacent triangulated structure.

18. The support structure for providing support in a boat hull according to claim 15 wherein the amount of nesting of adjacent triangulated structures is not constant.

19. A chevron rib structure for providing support in an aluminum boat hull, said boat having a fore, said structure comprising:

a hull, having a bow and a stem, the hull including opposite side sections formed of aluminum and extending along a length of said hull, said side sections combining at a keel line extending along a longitudinal center axis of said hull;

a plurality of symmetric V-shaped ribs pointing to said fore of the boat, each said V-shaped rib being secured to an inner surface of said hull and aligned with respect to other said V-shaped ribs in a chevron configuration, each of said ribs including first and second legs which join at a first angle to form said V-shape, wherein each said first leg directly contacts a corresponding second leg at said keel line of said boat, so that said first legs are not separated from the corresponding second legs, said legs having lower surfaces secured to said hull, wherein said V-shaped ribs extend substantially the entire distance from said bow to said stern; and a plurality of cross beams, each of said cross beams being secured to at least one corresponding V-shaped rib, each of said cross beams traversing said boat hull.

20. The structure of claim 19 wherein each of said ribs has a summit section proximate an apex thereof and a valley section between adjoining legs, and wherein said ribs are positioned proximate one another such that said summit section of each rib extends into said valley section of a preceding rib located fore thereof.

* * * * *